US006047976A

United States Patent [19]

Wang

[11] Patent Number: 6,047,976

[45] Date of Patent: Apr. 11, 2000

[54] PORTABLE STORAGE CONTAINER

[76] Inventor: King-Sheng Wang, No 17, Lane 116, Ta An Kang Rd., Ta Chia Chen, Taichung Hsien, Taiwan

[21] Appl. No.: 09/153,882

[22] Filed: Sep. 16, 1998

[51] Int. Cl.[7] ..... B62B 1/00; F25D 3/08

[52] U.S. Cl. ..... 280/47.315; 280/47.17; 280/47.24; 280/37; 62/457.7

[58] Field of Search ..... 280/47.131, 47.16, 280/47.17, 47.18, 47.24, 47.315, 655, 655.1, 37; 190/18 A; 62/457.7, 239; 301/5.1, 37.1, 111, 125, 132; 220/256

[56] References Cited

U.S. PATENT DOCUMENTS

| | | | |
|---|---|---|---|
| 4,724,681 | 2/1988 | Bartholomew et al. | 280/47.17 X |
| 4,848,782 | 7/1989 | Schmidt | 280/47.17 X |
| 5,269,157 | 12/1993 | Ciminelli et al. | 280/47.18 X |
| 5,419,450 | 5/1995 | Guglielmelli et al. | 220/256 |
| 5,781,853 | 7/1998 | Johnson | 62/457.7 X |
| 5,806,143 | 9/1998 | Tsai | 280/47.315 X |
| 5,921,635 | 7/1999 | Deliman et al. | 301/111 |
| 5,987,701 | 11/1999 | Kuo | 280/47.24 X |
| 5,988,334 | 11/1999 | Caruso | 180/18 A |

*Primary Examiner*—Brian L. Johnson
*Assistant Examiner*—Florian Zeender
*Attorney, Agent, or Firm*—Bacon & Thomas, PLLC

[57] ABSTRACT

A portable storage container includes a top-open container body equipped with wheels and a retractable handle, and a container cover hinged to the container body and equipped with a carrying handle, the container cover having a bottom packing frame holding a heat insulative member adapted to close the opened top side of the container body, enabling the container body to be maintained in an air tight condition, and a plurality of top open chambers covered with a respective lift cover for keeping small items.

2 Claims, 7 Drawing Sheets

PORTABLE STORAGE CONTAINER

BACKGROUND OF THE INVENTION

The present invention relates to a storage container for use outdoors, and more particularly to a portable storage container which can conveniently be moved on the ground or carried by hand and, which is practical for keeping foods.

When taking a picnic or a pleasure-party outdoors, storage containers may be used to hold foods and a variety of articles. It is inconvenient to carry storage containers with storage items from place to place. Further, regular storage containers cannot keep foods fresh for long because they cannot keep their inside storage space in an air tight condition when closed.

SUMMARY OF THE INVENTION

The present invention has been accomplished to provide a storage container which eliminates the aforesaid problems. It is one object of the present invention to provide a storage container which keeps its inside storage space in an air tight condition so that storage foods can be kept fresh for long. It is another object of the present invention to provide a storage container which has openable storage chambers on the outside for keeping a variety of small items. It is still another object of the present invention to provide a storage container which can conveniently be moved on the ground or carried by hand. To achieve these and other objects of the present invention, there is provided a storage container comprised of a container body equipped with wheels, a carrying handle and a retractable handle, and a container cover hinged to the container body and adapted to close the opened top side of the container body, the container cover comprising a plurality of top open chambers respectively covered with a lift cover for keeping small items, a packing frame at the bottom side, two hanging rods respectively mounted on the packing frame at two opposite sides for hanging things, and a heat insulative member mounted within the packing frame and adapted to close the container body, keeping the container body in an air tight condition.

DETAILED DESCRIPTION OF THE PREFERRED EMBODIMENT

Figure 1:
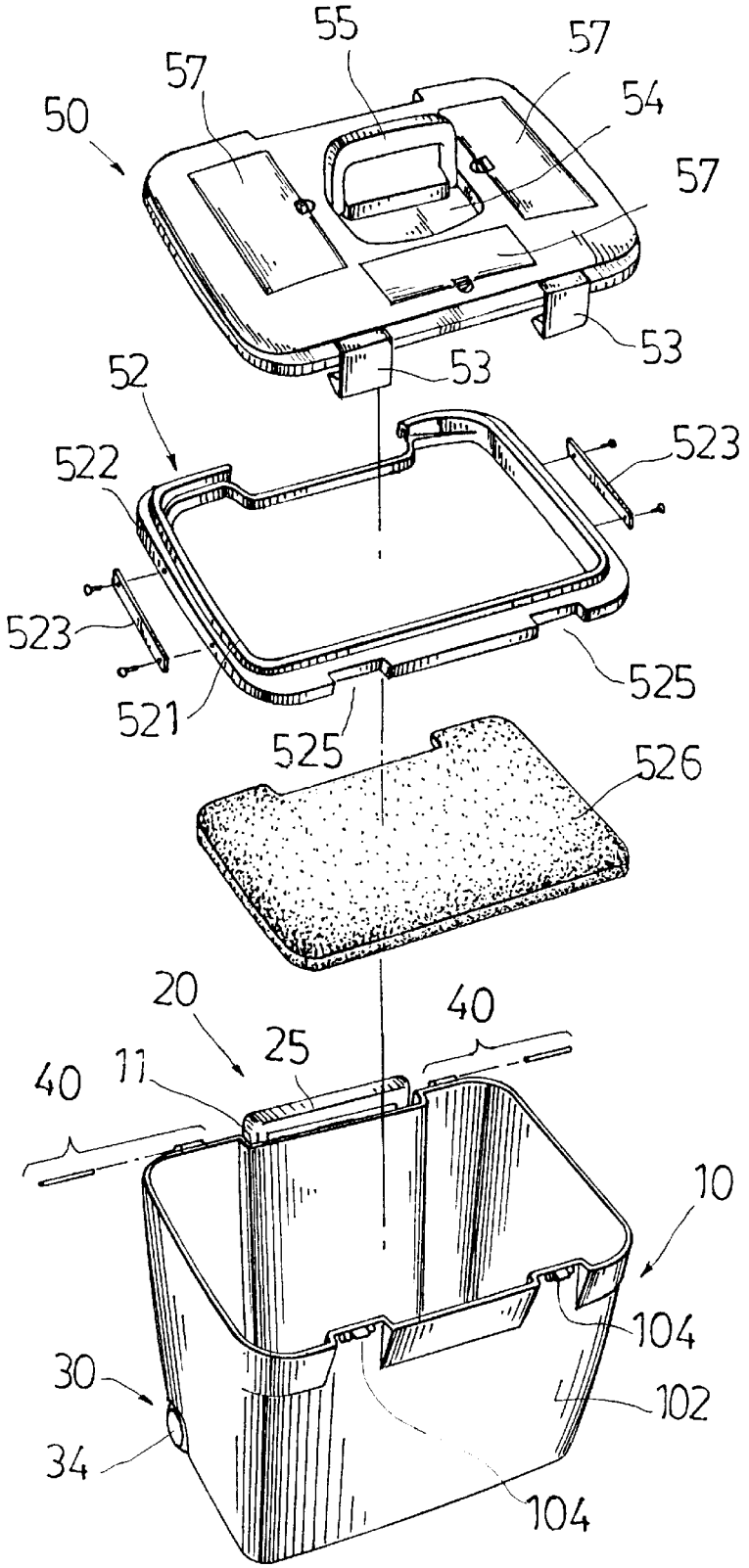
FIG. 1 is an exploded view of a portable storage container according to the present invention.
Figure 2:
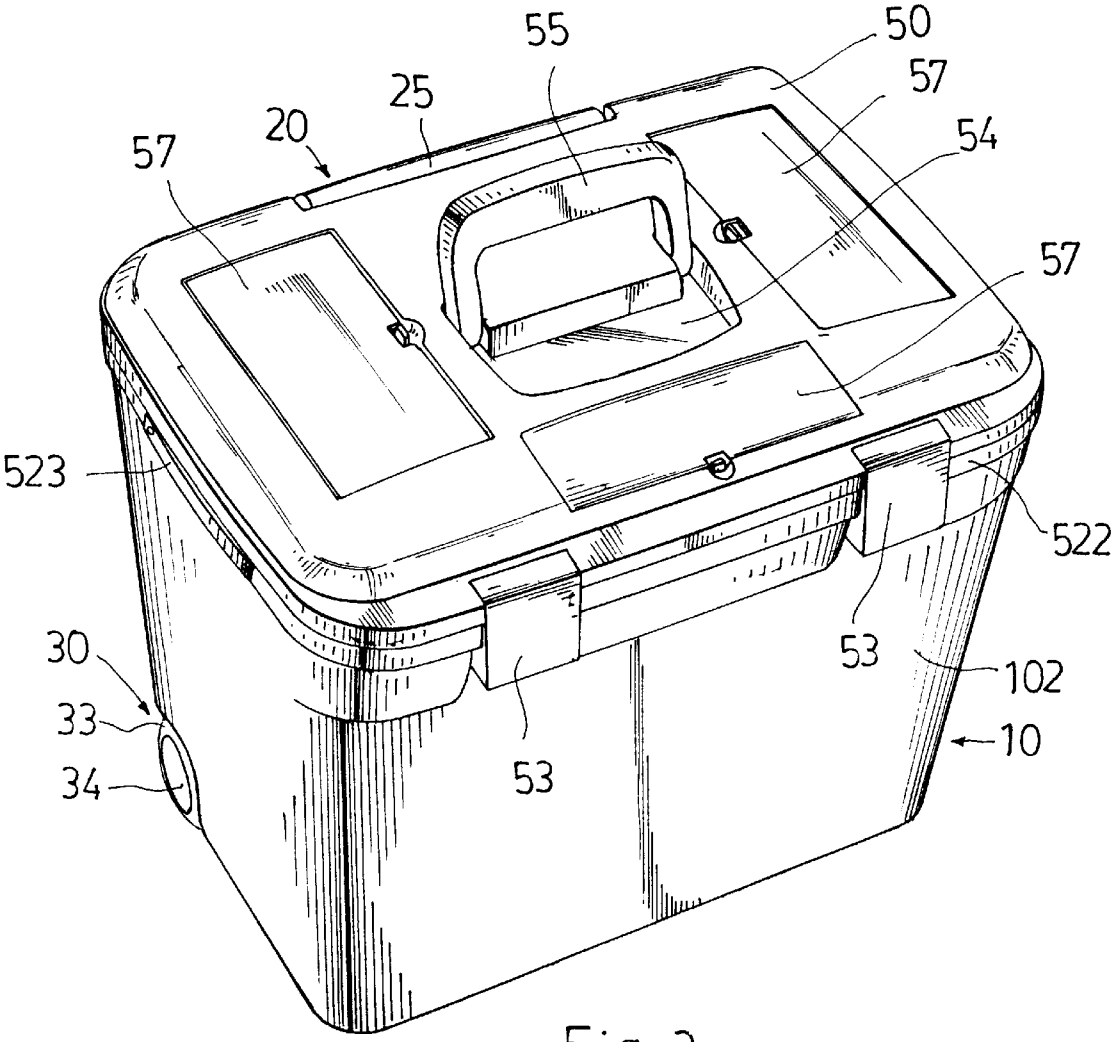
FIG. 2 is a perspective view of the present invention, showing the container cover closed on the container body.

Referring to FIGS. from 1 through 5, a portable storage container is shown comprised of a container body 10. The peripheral wall of the container body 10 is formed of an inner layer 101, an outer layer 102, and a narrow air tight chamber 103 defined between the inner layer 101 and the outer layer 102. The air tight chamber 103 reduces the interference of outside temperature. The container body 10 has a back recess 11. A retractable handle 20 is provided at the back recess 11.

Figure 6:
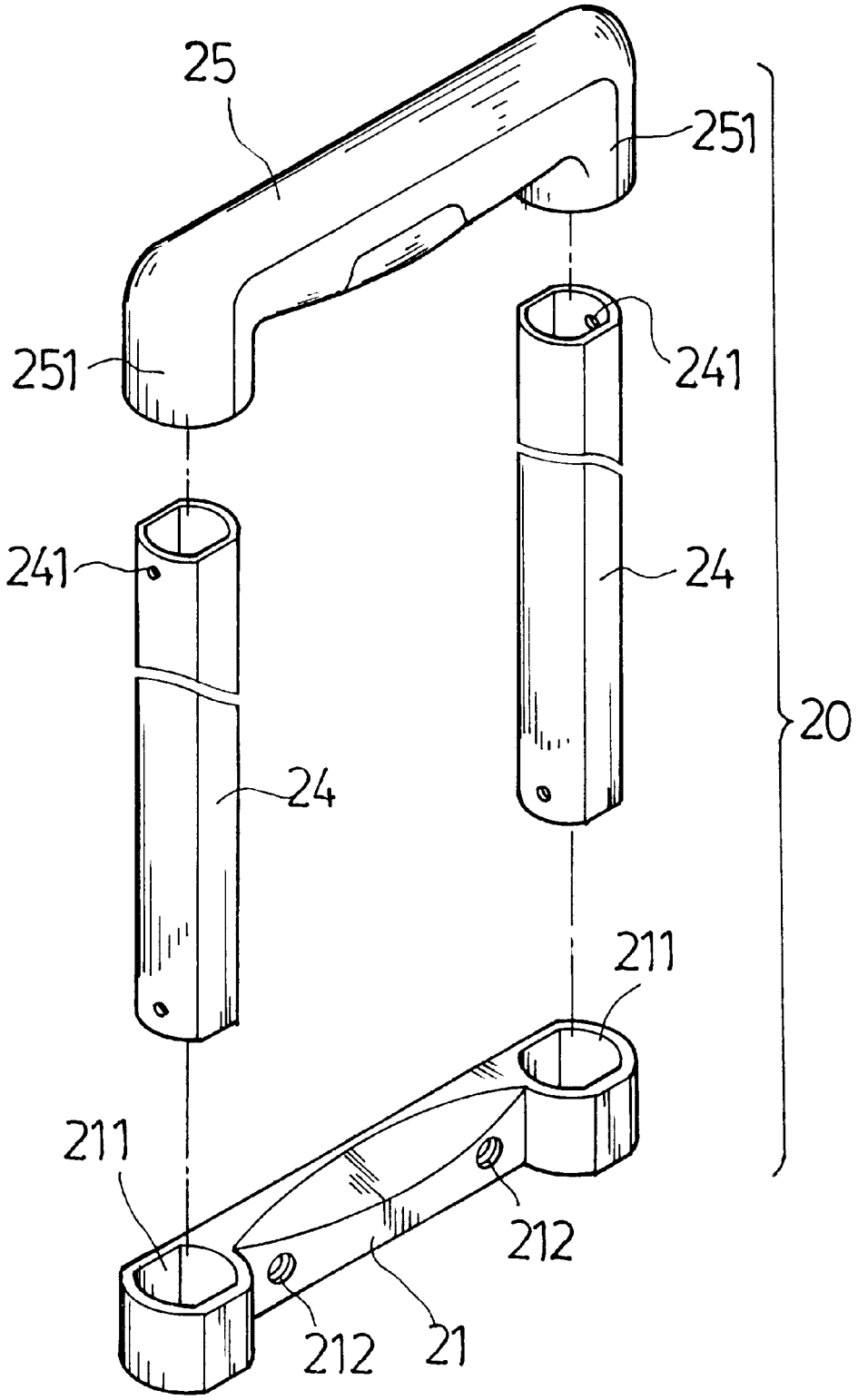
FIG. 6 is an exploded view of the retractable handle according to the present invention.
Figure 7:
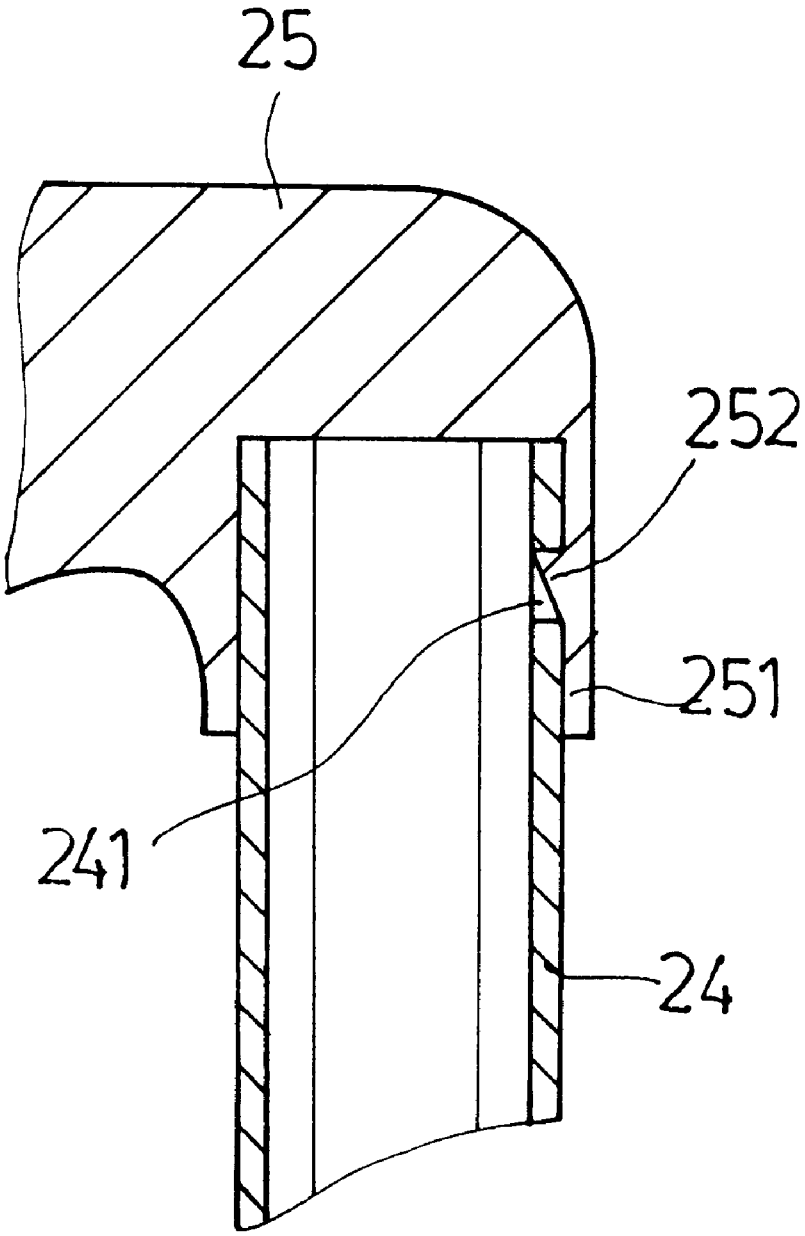
FIG. 7 is a sectional view of a part of the retractable handle, showing the triangular inside projection engaged into the side hole on the sliding tube according to the present invention.

Referring to FIGS. 6 and 7, the retractable handle 20 comprises a transverse holder frame 21 mounted in the back recess 11 of the container body 10, the transverse holder frame 21 having a plurality of mounting holes 212 fixedly fastened to the peripheral wall of the container body 10 within the back recess 11 by for example screws and two vertical through holes 211 at two opposite ends thereof, a hand grip 25 having two coupling tubes 251 downwardly extended from its two opposite ends, and two sliding tubes 24 respectively connected to the coupling tubes 251 of the hand grip 25 and inserted through the vertical through holes 211 of the transverse holder frame 21. The sliding tubes 24 each having a side hole 241 near the top. The coupling tubes 251 of the hand grip 25 each have a triangular inside projection 252. When the top ends of the sliding tubes 24 are fitted into the coupling tubes 251 of the hand grip 25, the inside projections 252 of the coupling tubes 251 are engaged into the side holes 241 on the sliding tubes 24 to secure the sliding tubes 24 in place. When assembled, the user can operate the hand grip 25 to pull the sliding tubes 24 out of the holder frame 21, or to push the sliding tubes 24 back to the inside of the holder frame 21. When the sliding tubes 24 are pushed back, the sliding tubes 24 are received inside the container body 10 (the back recess 11 of the container body 10 has two holes respectively aligned with the through holes 211 at the holder frame 21, so that the sliding tubes 24 can inserted through the holes on the back recess 11 and received inside the container body 10).

Figure 3:
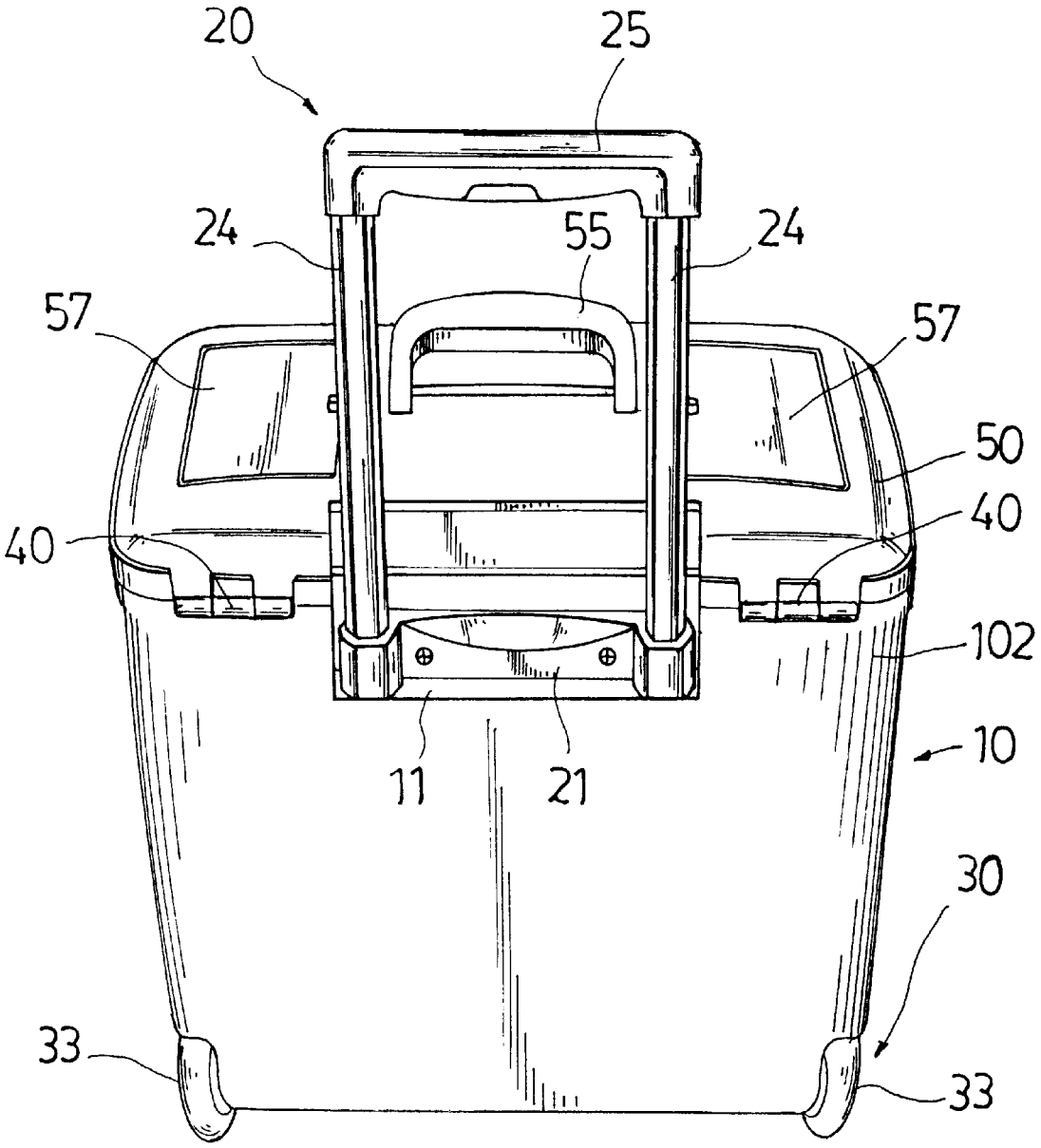
FIG. 3 is a back side view of the present invention, showing the retractable handle extended out.
Figure 4:
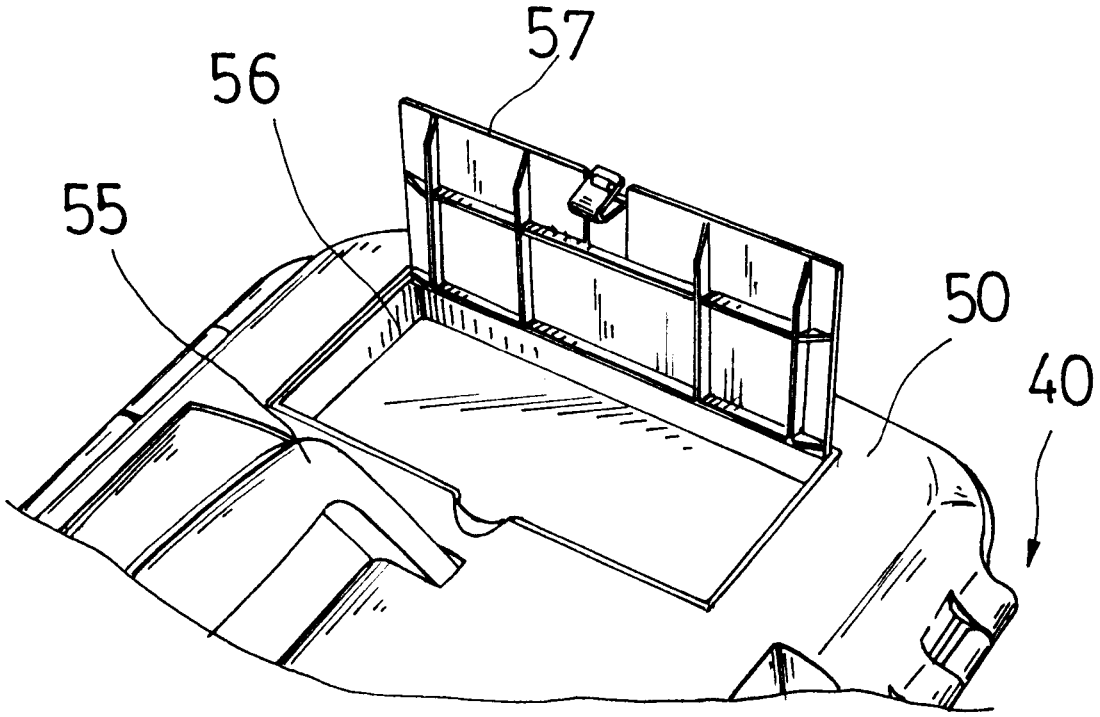
FIG. 4 is a partial view of the container cover, showing the arrangement of one top open chamber and the respective lift cover.
Figure 5:
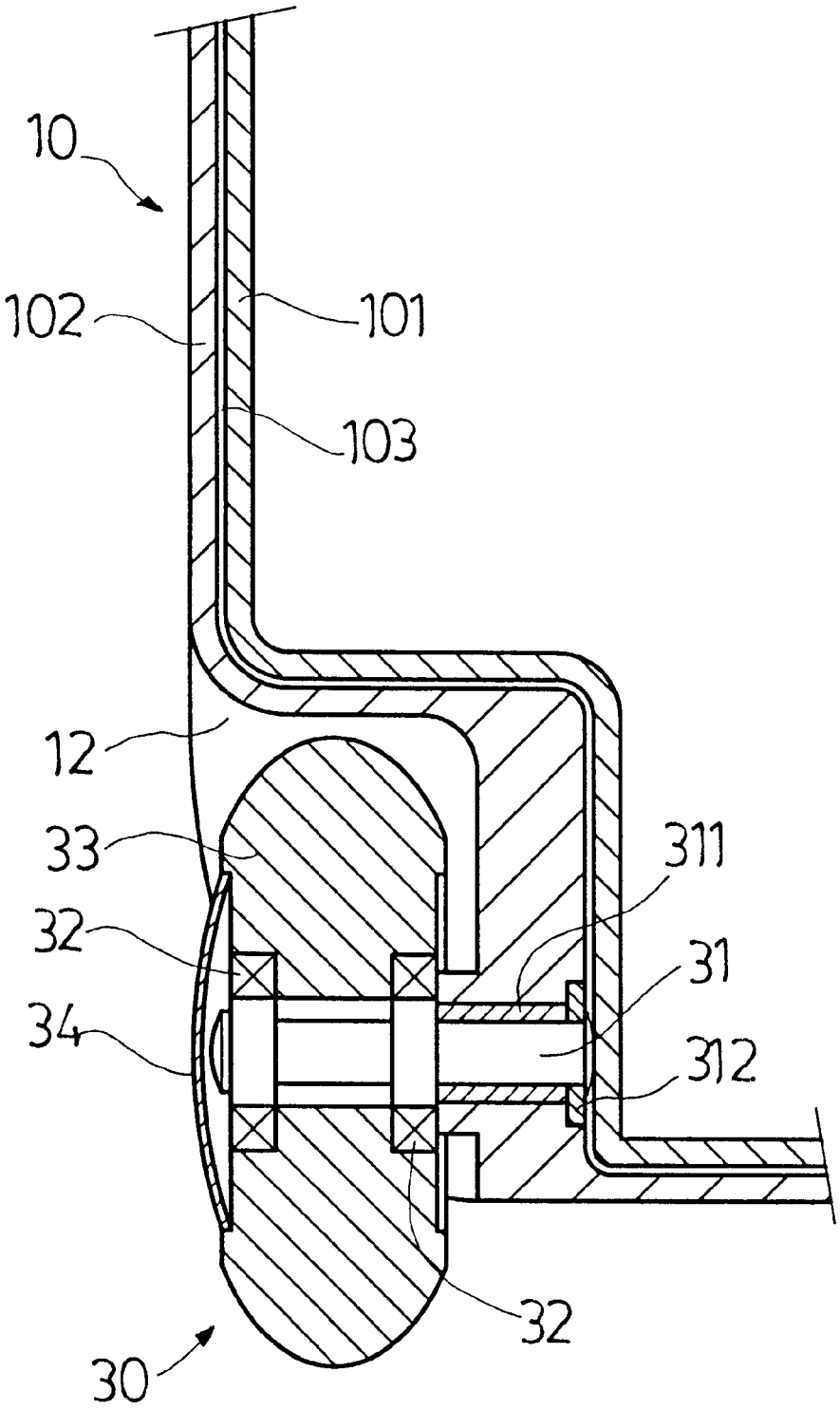
FIG. 5 is a sectional view of a part of the present invention, showing the structure of the wheel assembly.

Referring to FIGS. 3 and 5 again, the container body 10 comprises two recessed bottom chambers 12 bilaterally disposed at the bottom side of the back panel thereof. Two wheel assemblies 30 are installed in the recessed bottom chambers 12. Each wheel assembly 30 comprises a wheel axle 31, two axle bearings 32 mounted on the wheel axle 31, a wheel 33 supported on the axle bearings 32, a dust cap 34 covered on the wheel 33 at an outer side to protect the wheel axle 31 and the axle bearings 32 against dust. The wheel axle 31 has an inner end fitted into a metal bushing 311 in a hole on a thick part of the outer layer 102 of the container body 10 and fixedly secured to a fixed gasket ring 312 inside the outer layer 102 of the container body 10.

Referring to FIGS. from 1 through 4 again, a container cover 50 is hinged to the back panel of the container body 10 at the top by hinge means 40. The container cover 50 comprises a packing frame 52 at the bottom, and a flat heat insulative member 526 fixedly mounted within the packing frame 52. The size of the container cover 50 is greater than the opened top side of the container body 10. The packing frame 52 fits the periphery of the opened top side of the container body 10, comprising an upright coupling flange 521 coupled to the bottom side wall of the container cover 50, an outward peripheral flange 522, which closes the opened top side of the container body 10 when the container cover 50 is closed on the container body 10, two hanging rods 523 respectively fastened to the peripheral flange 522 at two opposite sides on which the clip of an apparatus for example a cellular telephone can be hung, and two front notches 525 at the front side of the peripheral flange 522. The container cover 50 further comprises a top recess 54, a carrying handle 55 hinged to the top recess 54 near one side, a plurality of top open chambers 56 respectively covered with a lift cover 57, and two hooks 53 suspended in the front notches 525 of the packing frame 52. The carrying handle 55 can be collapsed and received within the top recess 54 when not in use. When the container cover 50 is closed on the container body, the hooks 53 are respectively hooked on spring-supported retainer elements 104 at the front panel of the container body 10 to secure the container cover 50 in the closed position.

When in use, foods, personal articles, etc., can be stored in the container body 10. When the container cover 50 is closed on the container body 10, the user can pull the retractable handle 20 to move the storage container on the ground. Through the carrying handle 55, the storage container can conveniently be carried by hand.

When the container cover 50 is closed on the container body 10, the opened top side of the container body 10 is sealed by the flat heat insulative member 526, therefore the inside temperature of the container body 10 can be maintained at a fixed level for a length of time. Further, small items can be stored in the top open chambers 56 and well protected by the lift covers 57.

What is claimed is:

1. A portable storage container comprising:

a container body, said container body comprising a peripheral wall formed of an inner layer, an outer layer, and a narrow air tight chamber defined between said inner layer and said outer layer, said peripheral wall defining an opened top side, a back recess in said peripheral wall at the top side, and two recessed bottom chambers bilaterally disposed in said peripheral wall in a bottom side;

a retractable handle mounted on said container body within said back recess;

two wheel assemblies respectively mounted on said container body within said recessed bottom chambers for moving said container body on the ground, said wheel assemblies each comprising a wheel axle, two axle bearings mounted on said wheel axle, a wheel supported on said axle bearings, a dust cap covered on said wheel at an outer side, said wheel axle having an inner end fitted into a metal bushing in a hole on the outer layer of the peripheral wall of said container body and fixedly secured to a fixed gasket ring inside the outer layer of the peripheral wall of said container body;

a container cover hinged to the peripheral wall of said container body and adapted to close the opened top side of the peripheral wall of said container body, said container cover comprising a top recess, a plurality of top open chambers each chamber respectively covered with a lift cover, a packing frame at a bottom side thereof, two hanging rods respectively mounted on said packing frame at two opposite sides for hanging things, a heat insulative member mounted within said packing frame and adapted to seal the opened top side of the peripheral wall of said container body;

lock means provided at said container cover and said container body for locking said container cover when said container cover is closed on said container body; and a carrying handle hinged to said container cover within said top recess.

2. The portable storage container of claim 1 wherein said retractable handle comprises a transverse holder frame fixedly mounted in the back recess in the peripheral wall of said container body, said transverse holder frame having two vertical through holes arranged in parallel at two opposite ends thereof, a hand grip having downwardly extended end coupling tubes, and two sliding tubes respectively connected to the end coupling tubes of said hand grip and inserted through the vertical through holes of said transverse holder frame and moved in and out of a respective hole on said container body, said sliding tubes each having a top side hole, the coupling tubes of said hand grip each having a triangular inside projection respectively engaged into the top side holes of said sliding tubes to secure said sliding tubes to the end coupling tubes of said hand grip.

* * * * *